US007807927B2

(12) United States Patent
Yeh

(10) Patent No.: US 7,807,927 B2
(45) Date of Patent: Oct. 5, 2010

(54) TRANSMISSION LINE WITH HIGH FLEXIBILITY AND CHARACTERISTIC IMPEDANCE

(75) Inventor: Shih-Kun Yeh, Taoyuan Hsieh (TW)

(73) Assignee: Tennrich International Corp., Taoyuan Hsieh (TW)

( * ) Notice: Subject to any disclaimer, the term of this patent is extended or adjusted under 35 U.S.C. 154(b) by 258 days.

(21) Appl. No.: 12/209,604

(22) Filed: Sep. 12, 2008

(65) Prior Publication Data

US 2009/0277664 A1 Nov. 12, 2009

(30) Foreign Application Priority Data

May 8, 2008 (TW) ..... 97207956 U

(51) Int. Cl.
*H01B 7/00* (2006.01)

(52) U.S. Cl. ..... 174/110 R; 174/117 R; 174/117 F; 174/117 FF

(58) Field of Classification Search ..... 174/110 R, 174/113 R, 117 R, 117 F, 117 FF, 36
See application file for complete search history.

(56) References Cited

U.S. PATENT DOCUMENTS 3,448,204 A * 6/1969 Perrone et al. ..... 174/115
3,612,744 A * 10/1971 Thomas ..... 174/36
5,276,759 A * 1/1994 Nguyen et al. ..... 385/114
5,455,383 A * 10/1995 Tanaka ..... 174/36
5,532,429 A * 7/1996 Dickerson et al. ..... 174/36
7,399,929 B2 * 7/2008 Ueno et al. ..... 174/117 FF

* cited by examiner

*Primary Examiner*—William H Mayo, III
(74) *Attorney, Agent, or Firm*—Jackson IPG PLLC; Demian K. Jackson

(57) ABSTRACT

A transmission line including a flexible flat cable, an insulating layer and a metal layer, wherein the insulating layer and the metal layer are formed sequentially on a surface of the flexible flat cable to change the thickness of the insulating layer, in order to change the characteristic impedance (Z0) of the flexible flat cable. Particularly, the insulating layer is made of a woven fabric material, a foam material or a net material.

19 Claims, 11 Drawing Sheets

TRANSMISSION LINE WITH HIGH FLEXIBILITY AND CHARACTERISTIC IMPEDANCE

BACKGROUND OF THE INVENTION (a) Field of the Invention

The present invention relates to a transmission line, and more particularly to a transmission line with better characteristic impedance (Z0) and high flexibility.

(b) Description of the Related Art

With reference to FIG. 1 for transm+itting a LVDS signal, the signal communication between a liquid crystal display (LCD) and a host system involves a huge volume and a very high frequency, and thus the high frequency signal transmission established between an LCD interface 6 and a system motherboard interface 7 adopts a low voltage differential signal (LVDS) transceiver 9 with a super high speed (1.4 Gb/s), a low power consumption and a low electromagnetic interference (EMI) as the signal transmission interface of the LCD interface 6, and a signal transmission line 9 is provided for connecting the signal transmission interface of the system motherboard interface 7 (which is a connector socket 71 of the system motherboard interface 7) for a conventional LVDS signal transmission.

According to a LVDS interface standard defined by ANSI-YUA-EIA-644-I995, a signal transmission line 9 for a LVDS signal transmission must be a signal transmission line 9 with a characteristic impedance (Z0) equal to 100Ω±5% before the impedance (Z) of a circuit between the LCD interface 6 and the system motherboard interface 7 can be matched, and the LVDS signal transmission must satisfy this condition to achieve the effects of reducing the electromagnetic inference and noises, correctly executing the signal transmission between the LCD interface (or LVDS interface) 6 and the system motherboard interface 7 and preventing errors. If the aforementioned condition is not satisfied, signal reflections, noises, data loses, deformations or distortions may occur in signal transmissions between the LCD interface 6 and the system motherboard interface 7.

With reference to FIG. 2A for a schematic view of a conventional signal transmission line, a thicker insulating layer 92 and a metal layer 93 are attached sequentially on a surface of a flexible flat cable 91. With reference to FIG. 2B, the thickness of a plastic film layer 911 of a flexible flat cable 91 is increased to improve the insulating thickness of the flexible flat cable 91 for producing a compliant characteristic impedance (Z0). Regardless of increasing the thickness of the plastic film layer 911 or adding the insulating layer 92, a specific thickness of a poly (ethylene terephthalate (PET) material is required for complying with the requirements of the characteristic impedance (Z0), and its hardness will be relatively higher, and thus the flexible flat cable 91 complies with the required characteristic impedance (Z0) but the flexibility becomes lower, and the operation of the whole signal transmission line 9 becomes less flexible.

SUMMARY OF THE INVENTION

Therefore, it is a primary objective of the present invention to provide a transmission line for forming an electronic cable, an optical cable or a Serial Advanced Technology Attachment (SATA) cable, and applying the transmission line with a printed circuit board for LVDS signal transmissions to achieve better flexibility and higher characteristic impedance (Z0).

Another objective of the present invention is to provide a transmission line with high flexibility and better characteristic impedance (Z0).

To achieve the foregoing objectives, the present invention provides a transmission line with high characteristic impedance (Z0), comprising a flexible flat cable (FFC), an insulating layer and a metal layer, and the insulating layer and the metal layer are formed sequentially on a surface of the flexible flat cable to change the thickness of the insulating layer, so as to change the characteristic impedance (Z0) of the flexible flat cable and achieve the effect of transmitting signals stably. Particularly, the insulating layer is made of a woven fabric material, a foam material or a net material. Regardless of the thickness requirement, the transmission line comes with a better softness and a free flexibility to enhance the convenience of using the transmission line and fits a thin design of an electronic device with the transmission line.

DETAILED DESCRIPTION OF THE PREFERRED EMBODIMENTS

Figure 1:
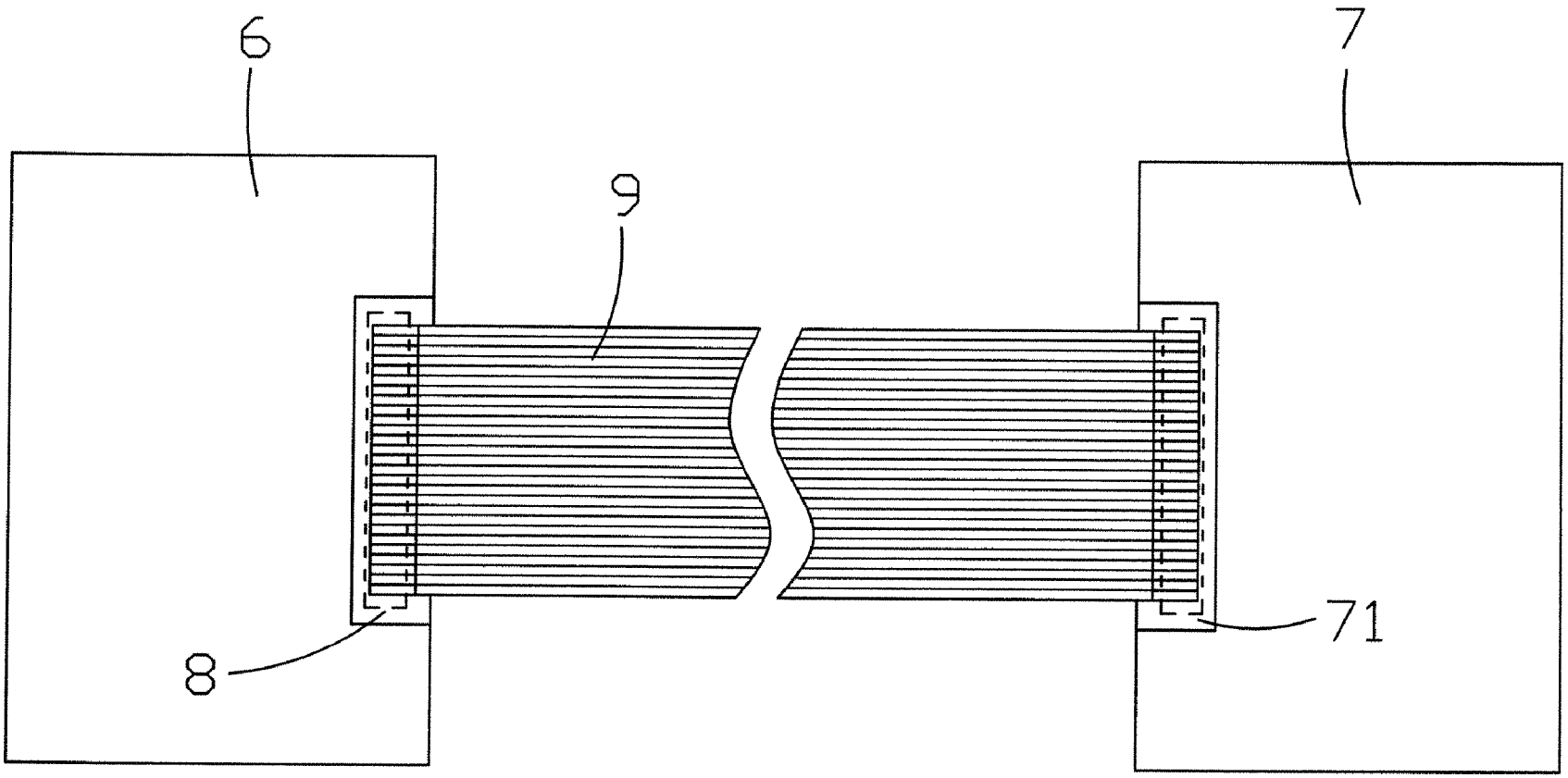
FIG.1 PRIOR ART
FIG. 1 is a schematic view of transmitting a LVDS signal between an LCD interface and a system motherboard interface in accordance with a prior art.
Figure 2A:
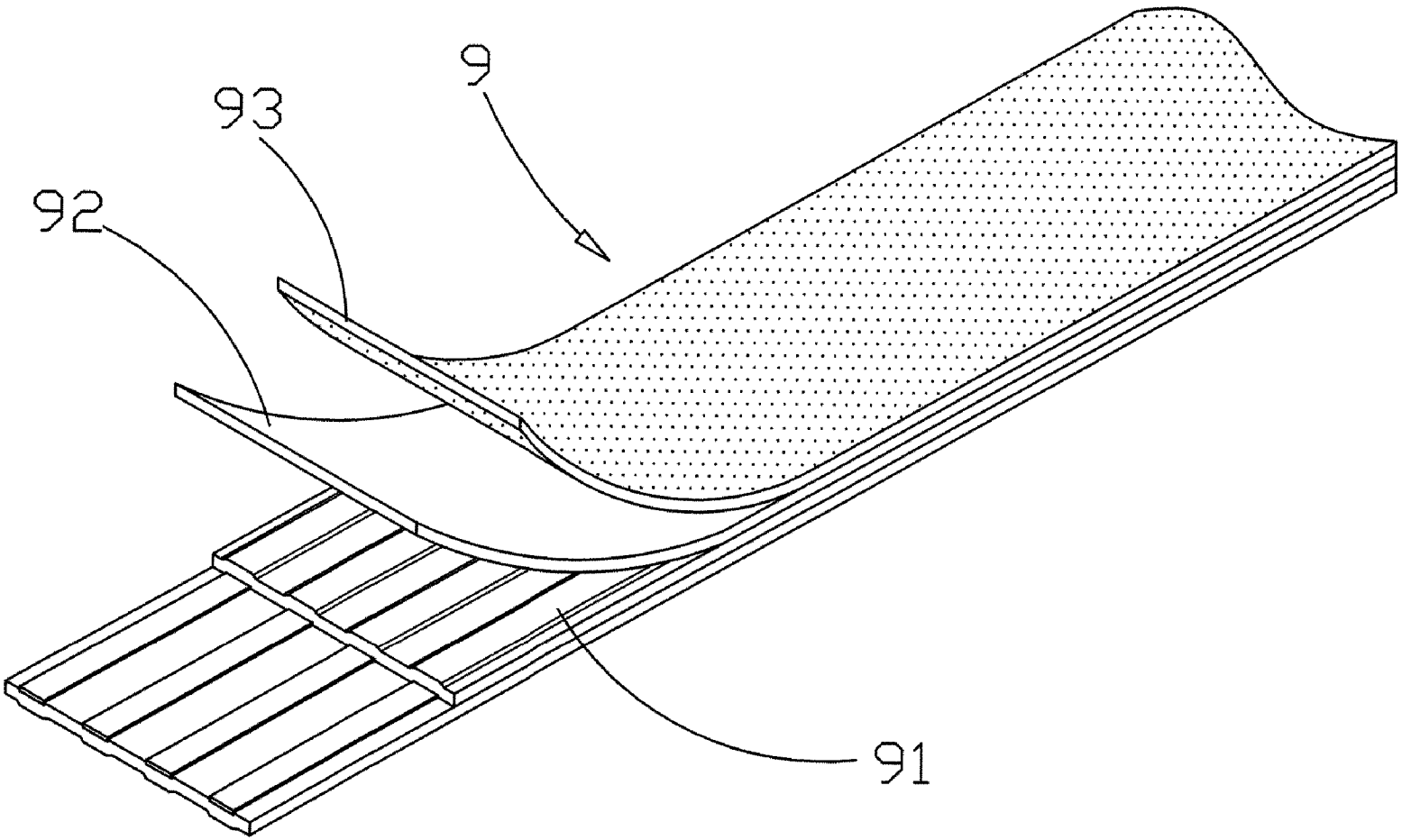
FIG.2A PRIOR ART
FIG. 2A is a schematic view of a conventional signal transmission line.
Figure 2B:
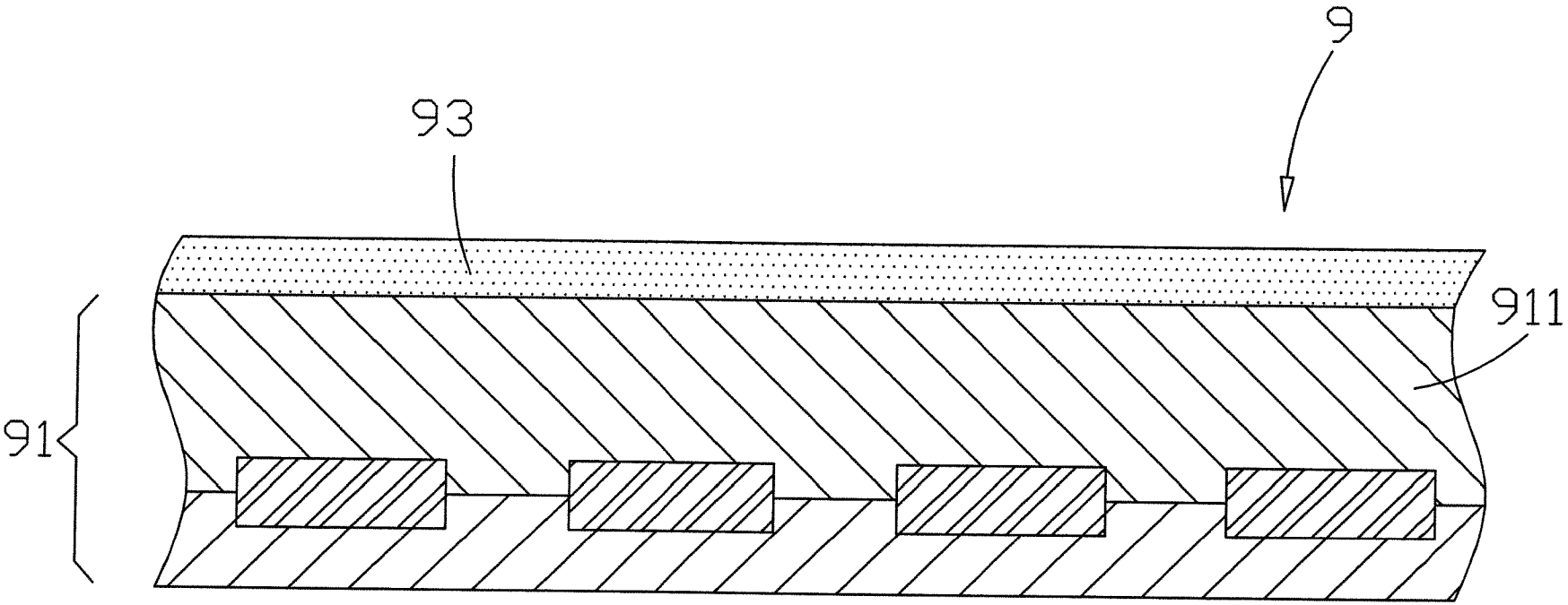
FIG.2B PRIOR ART
FIG. 2B is another schematic view of a conventional signal transmission line.
Figure 3:
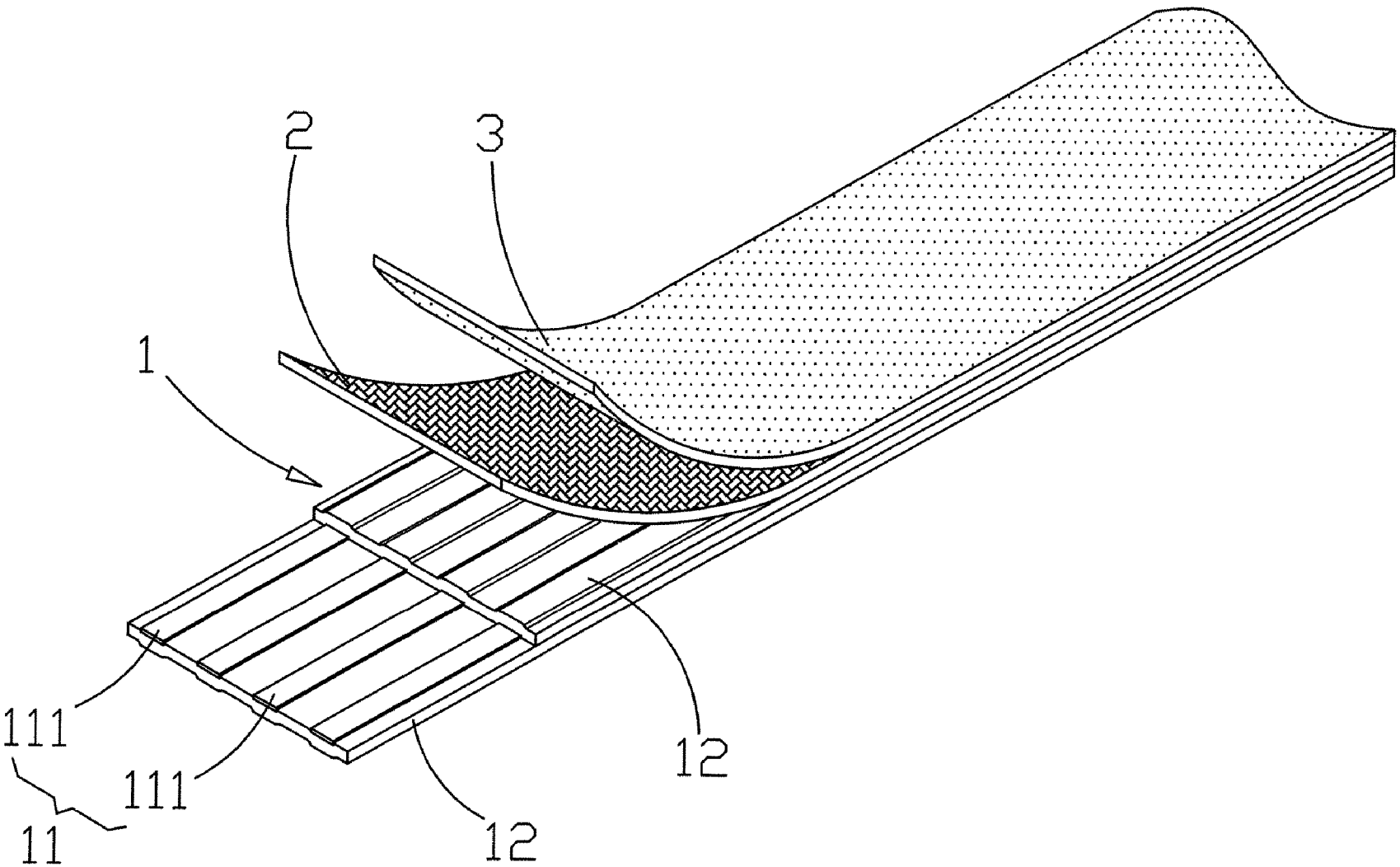
FIG. 3 is an exploded view of a first preferred embodiment of the present invention.
Figure 4:
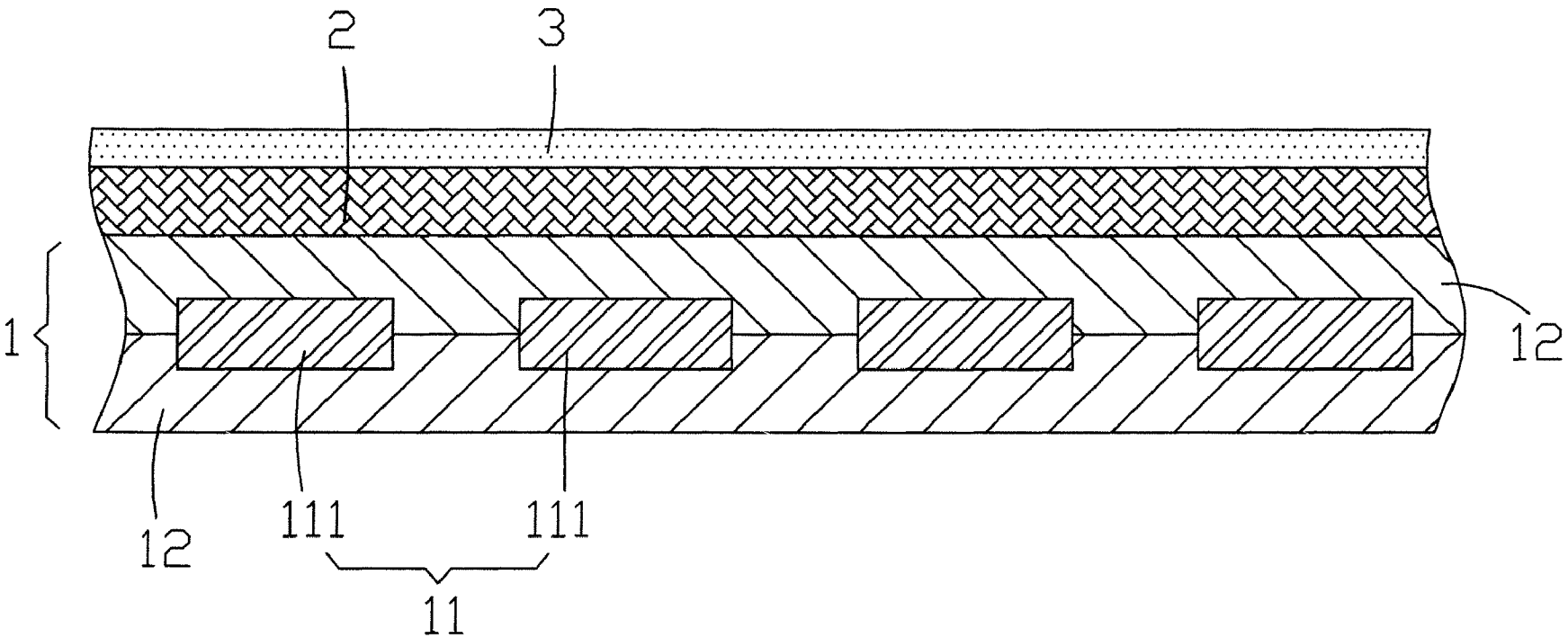
FIG. 4 is a cross-sectional view of a first preferred embodiment of the present invention.

With reference to FIGS. 3 and 4 for a transmission line with high flexibility and characteristic impedance of the present invention, the transmission line comprises a flexible flat cable (FFC) 1, an insulating layer 2 and a metal layer 3.

The flexible flat cable 1 comprises a conducting layer 11 including a plurality of parallel copper wires 111, and a plastic film layer 12 disposed separately on both sides of the conducting layer 11, wherein the plastic film layer 12 is made of a poly (ethylene terephthalate) (PET) or epoxy material, and the two plastic film layers 12 are laminated to include the conducting layer 11 between the two plastic film layers 12 integrally. The manufacturing process is simple, and the manufacturing cost is low, and the transmission line so produced comes with the soft, fire-resisting and temperature resisting features.

The insulating layer 2 and the metal layer 3 are formed sequentially on a surface of the plastic film layer 12 on a side of the flexible flat cable 1 for increasing the insulating thickness of the flexible flat cable 1 to form a transmission line with a better characteristic impedance (Z0) (such as a transmission line with the characteristic impedance (Z0) equal to 100Ω±5%), and the thickness of the insulating layer 2 can be changed to meet the requirement of a different characteristic impedance (Z0).

Figure 5:
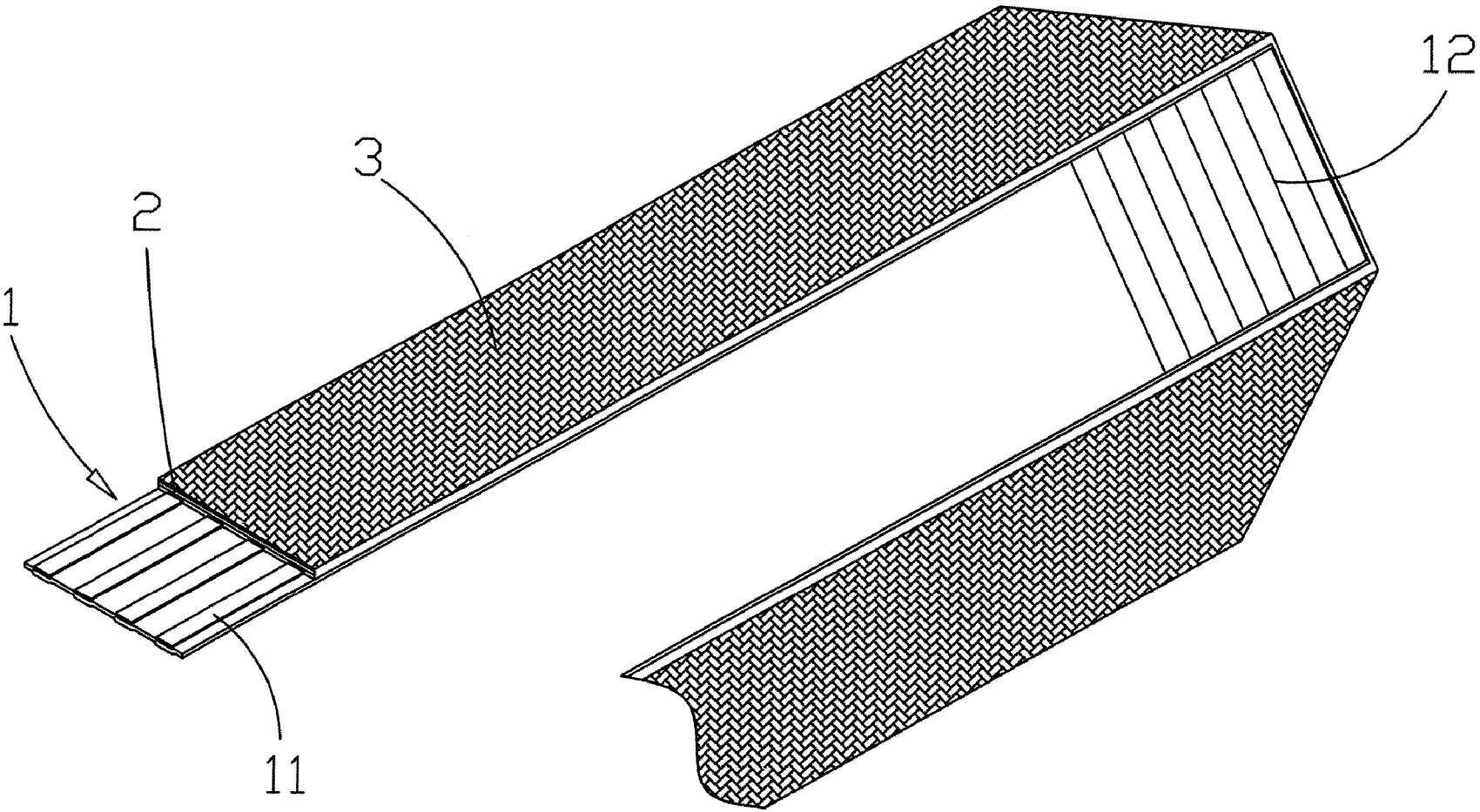
FIG. 5 is a schematic view of an application of a first preferred embodiment of the present invention.

In the transmission line with better characteristic impedance (Z0) in accordance with the present invention, the insulating layer 2 is made of an insulating woven fabric material, foam material or net material. The woven fabric material includes a nylon cloth, a polyester cloth, a polyester fiber cloth or an unwoven cloth, and the foam material includes a polyurethane (PU) or polyethylene (PE) material, and the net material is a plastic net material. The woven fabric material, the foam material or the net material come with high softness and flexibility. Regardless of the thickness, the aforementioned characteristics can be maintained, and thus the insulating layer 2 made of the woven fabric material, the foam material or the net material applied for manufacturing a transmission line with better characteristic impedance (Z0) as shown in FIG. 5, the transmission line can be bent freely and flexibly according to the internal structure of an electronic device (not shown in the figure) to meet the requirements of the electronic device, so that the transmission line can fit a thin design of the electronic device.

In the foregoing preferred embodiment, the insulating layer 2 and the metal layer 3 are formed integrally on the flexible flat cable 1, or the insulating layer 2 and the metal layer 3 are attached onto the flexible flat cable 1.

Figure 6:
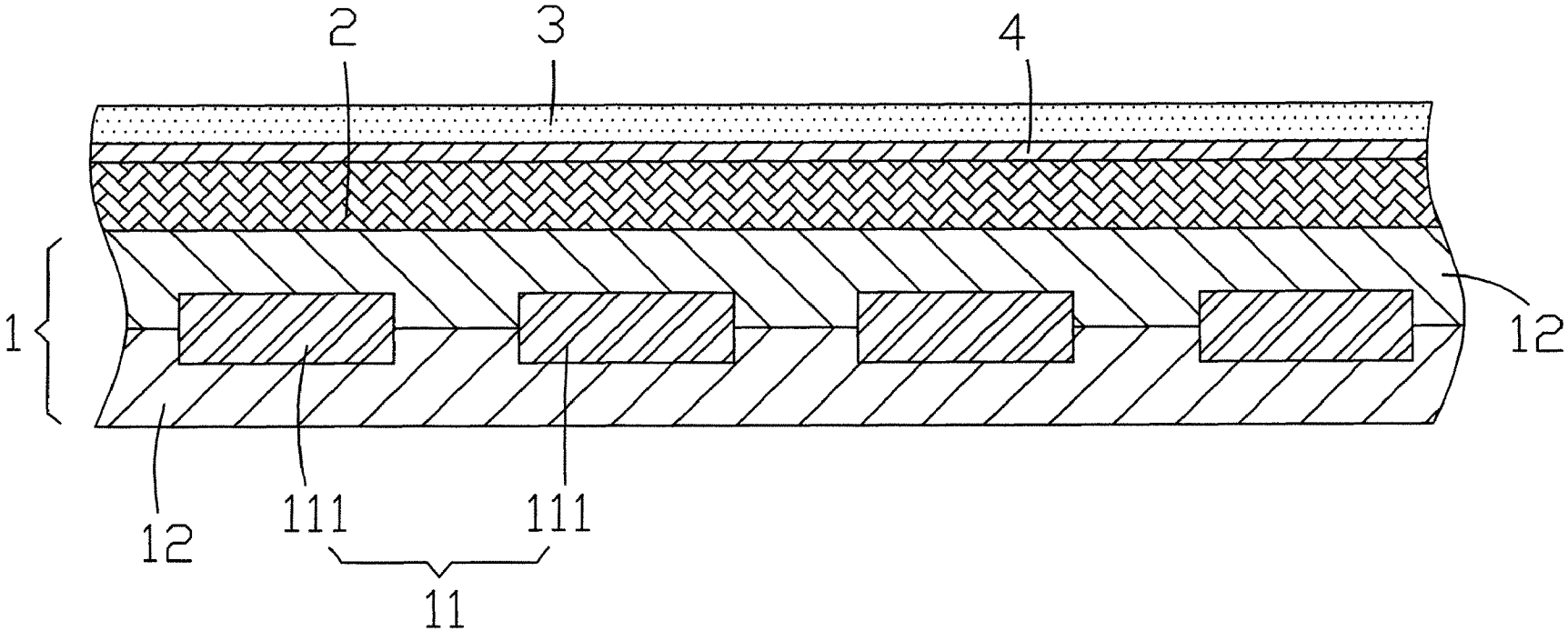
FIG. 6 is a cross-sectional view of a second preferred embodiment of the present invention.

In FIG. 6, an isolating layer 4 made of a poly (ethylene terephthalate (PET) or polyimide material is disposed between the insulating layer 2 and the metal layer 3, such that the isolating layer 4 can attach the insulating layer 2 and the metal layer 3 more securely and satisfy the requirement of better characteristic impedance (Z0) more effectively.

Figure 7:
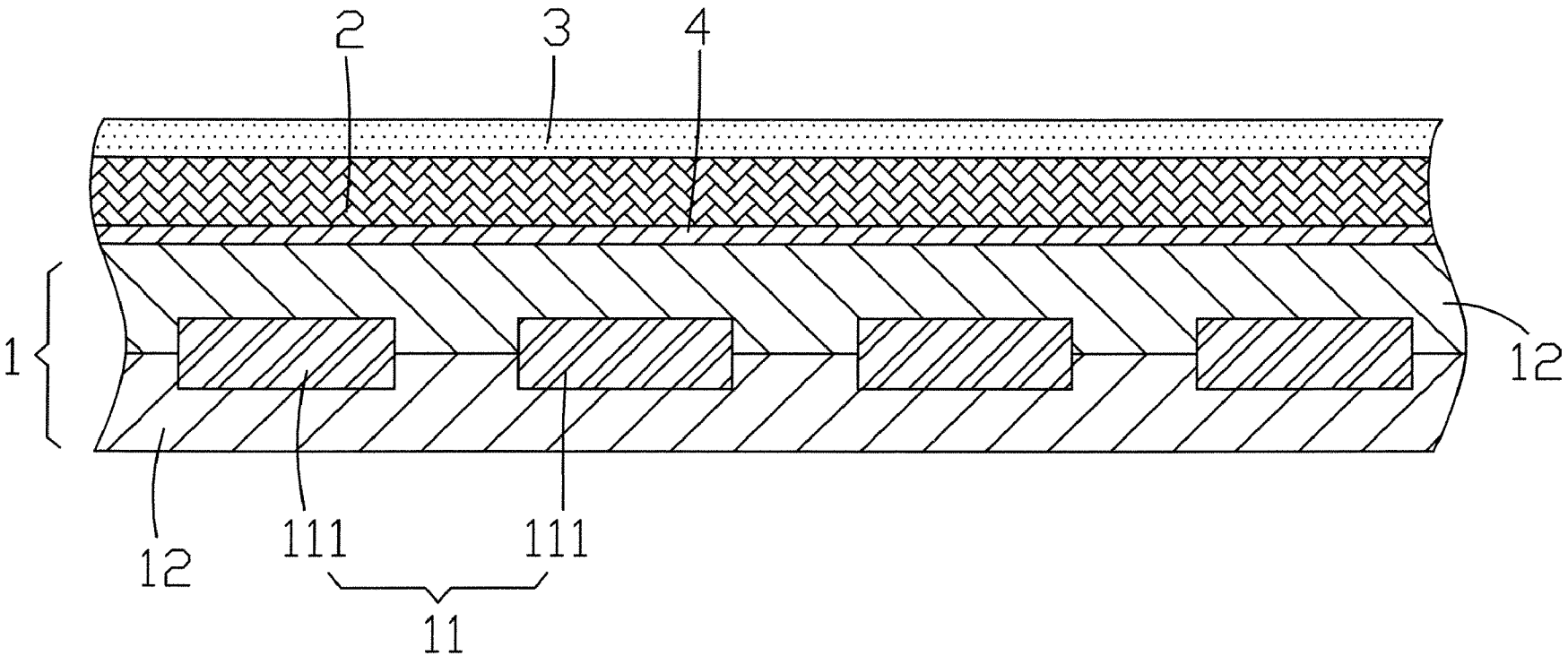
FIG. 7 is a cross-sectional view of a third preferred embodiment of the present invention.
Figure 8:
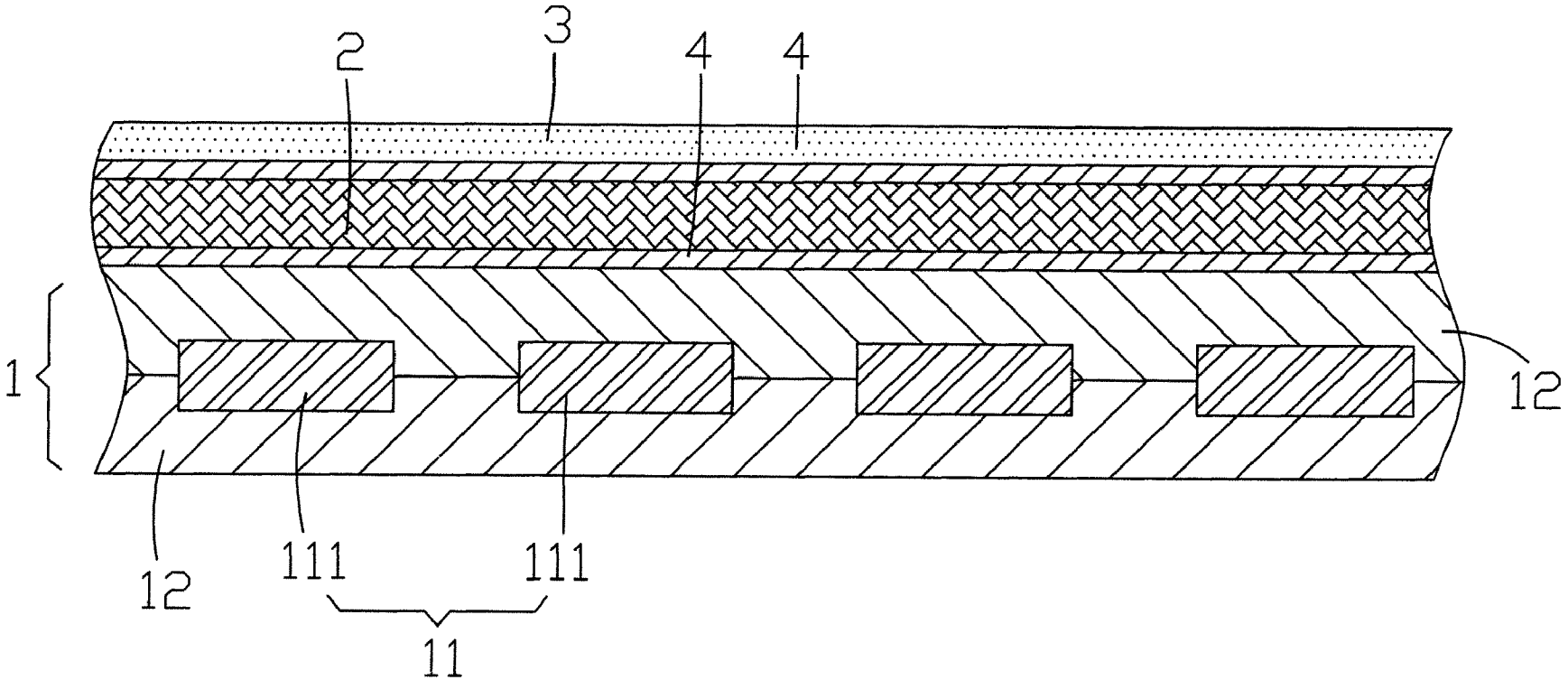
FIG. 8 is a cross-sectional view of a fourth preferred embodiment of the present invention.
Figure 9:
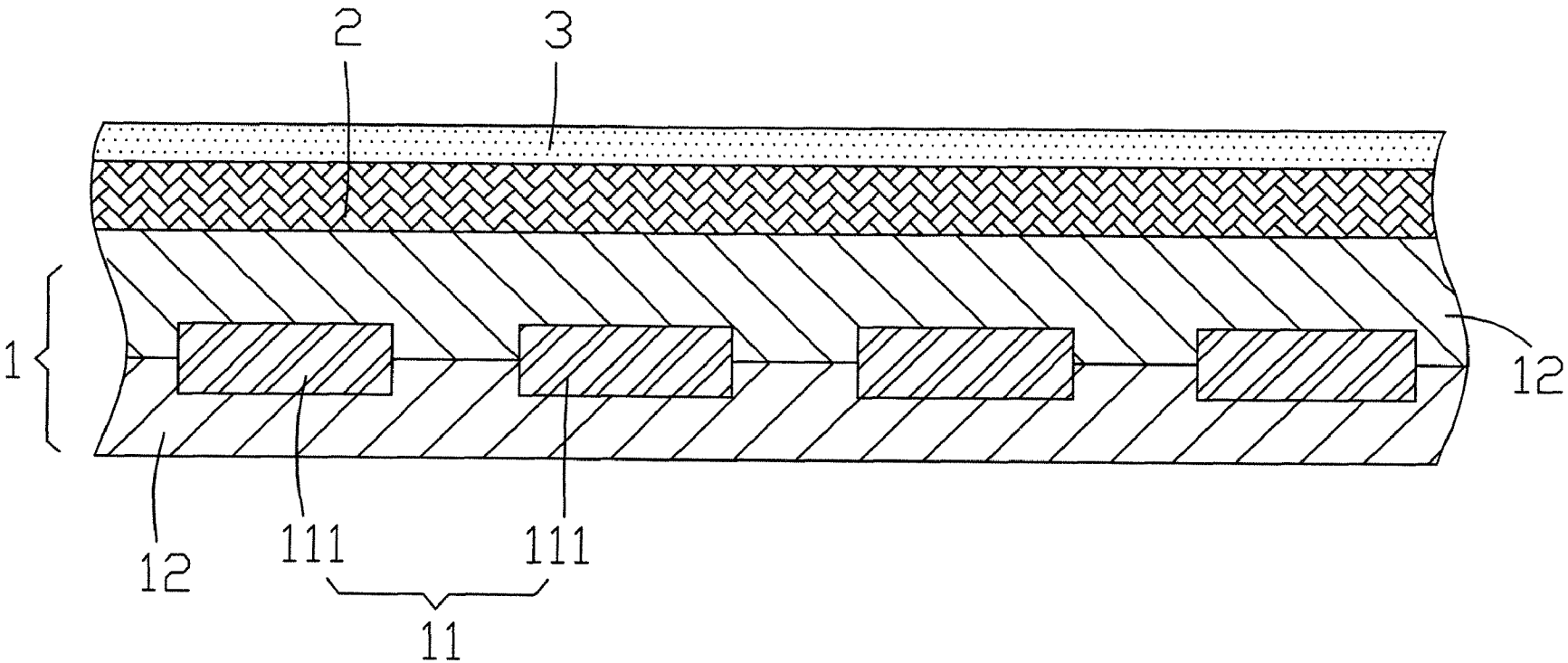
FIG. 9 is a cross-sectional view of a fifth preferred embodiment of the present invention.
Figure 10:
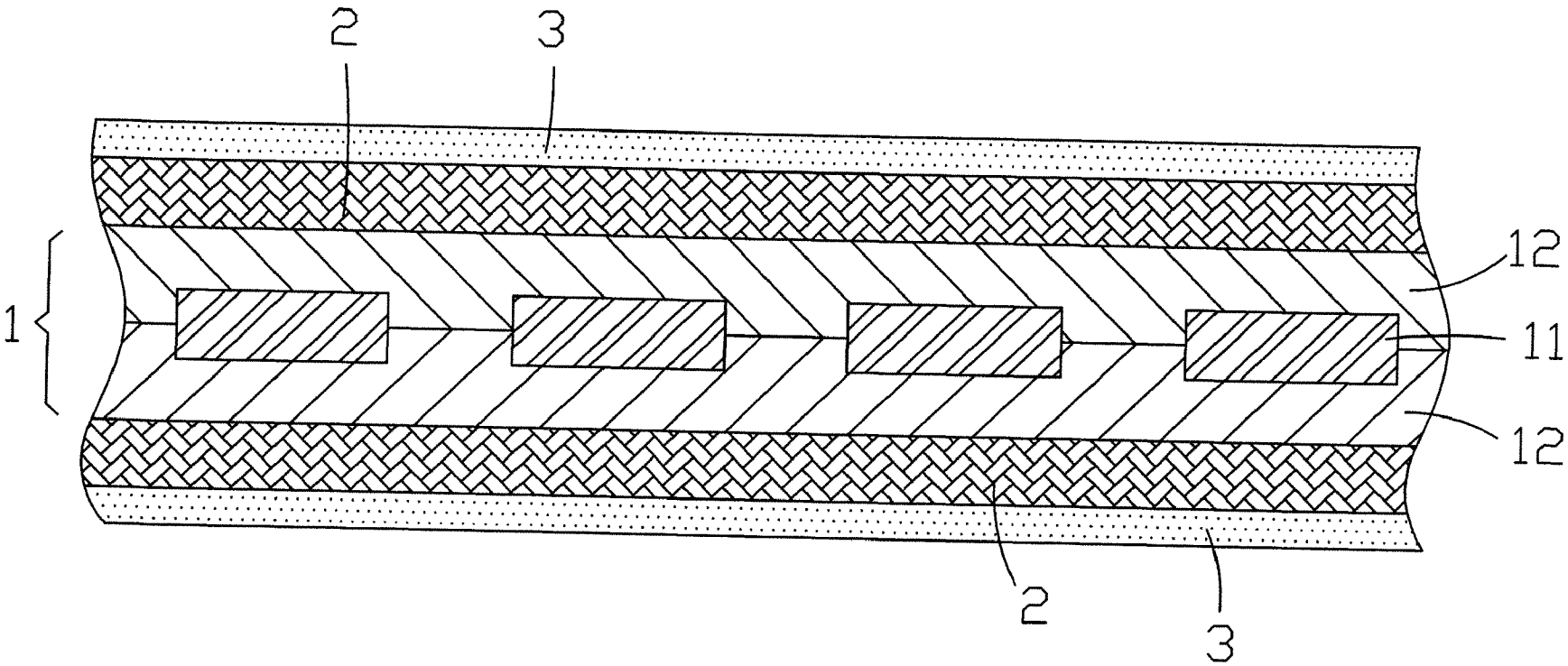
FIG. 10 is a cross-sectional view of a sixth preferred embodiment of the present invention.

In FIG. 7, an isolating layer 4 made of a poly (ethylene terephthalate (PET) or polyimide material is disposed between the plastic film layer 12 and the insulating layer 2 on a side of the flexible flat cable 1. In FIG. 8, an isolating layer 4 made of a poly (ethylene terephthalate (PET) or polyimide material is disposed between the plastic film layer 12 and the insulating layer 2 on a side of the flexible flat cable 1, and an isolating layer 4 made of a poly (ethylene terephthalate (PET) or polyimide material is disposed between the insulating layer 2 and the metal layer 3. Of course, the thickness of the plastic film layer 12 on a side of the flexible flat cable 1 can be increased as shown in FIG. 9, or the insulating layer 2 and the metal layer 3 are disposed on a side of the flexible flat cable 1 and an insulating layer 2 and a metal layer 3 are disposed on another side of the flexible flat cable 1 as shown in FIG. 10 to achieve the requirement of a different characteristic impedance (Z0).

The transmission line of the invention can be an electronic cable, an optical cable, a Serial Advanced Technology Attachment (SATA) cable, or applied for transmitting a LVDS, USB, SATA, ODD, RJ11, RJ45, 1394 or PCI signal. Of course, the present invention can further comprise two printed circuit boards installed to both ends of the flexible flat cable, and a plurality of circuits installed on a side of each printed circuit board, and each circuit is connected with the conducting layer. A connecting device connected to each circuit is disposed on the printed circuit board and corresponding to each circuit, wherein the connecting device can be an optical disc drive (ODD), a serial ATA (SATA) port, a high definition multimedia interface (HDMI) port, a universal serial bus (USB) port or a D-sub interface port.

While the invention has been described by means of specific embodiments, numerous modifications and variations could be made thereto by those skilled in the art without departing from the scope and spirit of the invention set forth in the claims.

I claim:

1. A transmission line with high flexibility and characteristic impedance, comprising:

a flexible flat cable, having a conducting layer and a plastic film layer disposed separately on both sides of the conducting layer;

an insulating layer, made of a woven fabric material, a foam material, or a net material, and disposed on a surface of a plastic film layer at a side of a flexible flat cable; and a metal layer, disposed on the insulating layer and corresponding to another side of the flexible flat cable.

2. The transmission line with high flexibility and characteristic impedance of claim 1, wherein the woven fabric material is a nylon cloth, a polyester cloth, a polyester fiber cloth or an unwoven cloth.

3. The transmission line with high flexibility and characteristic impedance of claim 1, wherein the foam material is polyurethane (PU) or polyethylene (PE).

4. The transmission line with high flexibility and characteristic impedance of claim 1, wherein the net material is a plastic material.

5. The transmission line with high flexibility and characteristic impedance of claim 1, wherein the conducting layer includes a plurality of copper wires arranged parallel with each other.

6. The transmission line with high flexibility and characteristic impedance of claim 1, wherein the plastic film layer is a poly (ethylene terephthalate) (PET) material or an epoxy material.

7. The transmission line with high flexibility and characteristic impedance of claim 1, further comprising two printed circuit boards coupled to both ends of the flexible flat cable respectively, and a plurality of circuits coupled to a side of each printed circuit board, and each circuit being coupled to the conducting layer.

8. The transmission line with high flexibility and characteristic impedance of claim 7, wherein each printed circuit board includes a connecting device installed at a side of each circuit and coupled with each circuit.

9. The transmission line with high flexibility and characteristic impedance of claim 8, wherein the connecting device is an optical disc drive (ODD), a Serial ATA (SATA) port, a high-definition multimedia interface (HDMI) port, a universal serial bus (USB) port or a D-sub interface port.

10. The transmission line with high flexibility and characteristic impedance of claim 1, wherein the transmission line is an electronic cable.

11. The transmission line with high flexibility and characteristic impedance of claim 1, wherein the transmission line is an optical cable.

12. The transmission line with high flexibility and characteristic impedance of claim 1, wherein the transmission line is a Serial Advanced Technology Attachment (SATA) transmission line.

13. The transmission line with high flexibility and characteristic impedance of claim 1, wherein the transmission line is applied for transmitting a LVDS, USB, SATA, ODD, RJ11, RJ45, 1394 or PCI signal.

14. The transmission line with high flexibility and characteristic impedance of claim 1, wherein the insulating layer and the metal layer are formed integrally onto the flexible flat cable.

15. The transmission line with high flexibility and characteristic impedance of claim 1, wherein the insulating layer and the metal layer are disposed on the flexible flat cable by an attaching method.

16. The transmission line with high flexibility and characteristic impedance of claim 1, further comprising an isolating layer made of a poly (ethylene terephthalate (PET) or polyimide material and disposed between the insulating layer and the metal layer.

17. The transmission line with high flexibility and characteristic impedance of claim 1, further comprising an isolating layer made of a poly (ethylene terephthalate (PET) or polyimide material and disposed between the plastic film layer and the insulating layer on a side of the flexible flat cable.

18. The transmission line with high flexibility and characteristic impedance of claim 1, further comprising an isolating layer made of a poly (ethylene terephthalate (PET) or polyimide material and disposed between the plastic film layer and the insulating layer on a side of the flexible flat cable, and an isolating layer made of a poly (ethylene terephthalate (PET) or polyimide material and disposed between the insulating layer and the metal layer.

19. The transmission line with high flexibility and characteristic impedance of claim 1, wherein the flexible flat cable includes the insulating layer and the metal layer on a side of the flexible cable, and an insulating layer and a metal layer on another side of the flexible cable.

* * * * *